US006060661A

United States Patent [19]

O'Neill

[11] Patent Number: 6,060,661

[45] Date of Patent: May 9, 2000

[54] SECURITY DEVICE

[75] Inventor: Edward L. O'Neill, Castro Valley, Calif.

[73] Assignee: Lucasey Manufacturing Company, Oakland, Calif.

[21] Appl. No.: 09/036,632

[22] Filed: Mar. 7, 1998

[51] Int. Cl.[7] ..... H01H 9/02

[52] U.S. Cl. ..... 174/58; 174/66; 220/241; 248/284.1; 403/363

[58] Field of Search ..... 174/17 CT, 50, 174/58, 66; 403/363, 337; 248/284.1, 291.1; 220/3.5, 3.8, 241

[56] References Cited

U.S. PATENT DOCUMENTS

| | | | |
|---|---|---|---|
| 3,830,374 | 8/1974 | Kassimir | 211/1 |
| 3,939,985 | 2/1976 | Hochman | 248/220.22 |
| 4,697,776 | 10/1987 | Edson | 248/311.2 |
| 4,709,891 | 12/1987 | Barnett | 248/214 |
| 5,188,326 | 2/1993 | Zich | 248/220.41 |

FOREIGN PATENT DOCUMENTS

| | | | |
|---|---|---|---|
| 2080095 | 2/1982 | United Kingdom | 248/284.1 |
| 2175216 | 11/1986 | United Kingdom | 248/291.1 |

*Primary Examiner*—Dean A. Reichard
*Assistant Examiner*—Dhiro R Patel
*Attorney, Agent, or Firm*—Niro, Scavone, Haller & Niro

[57] ABSTRACT

A security device for securing a device to store shelving units such as gondolas having a clamp made from two sections that are secured to the gondola by threaded fasteners. The device is enclosed in a outer housing formed by two sections that fit within one another that are secured together by threaded fasteners. The housing unit is then fastened to the clamp to complete the security unit.

14 Claims, 2 Drawing Sheets

FIG. 2
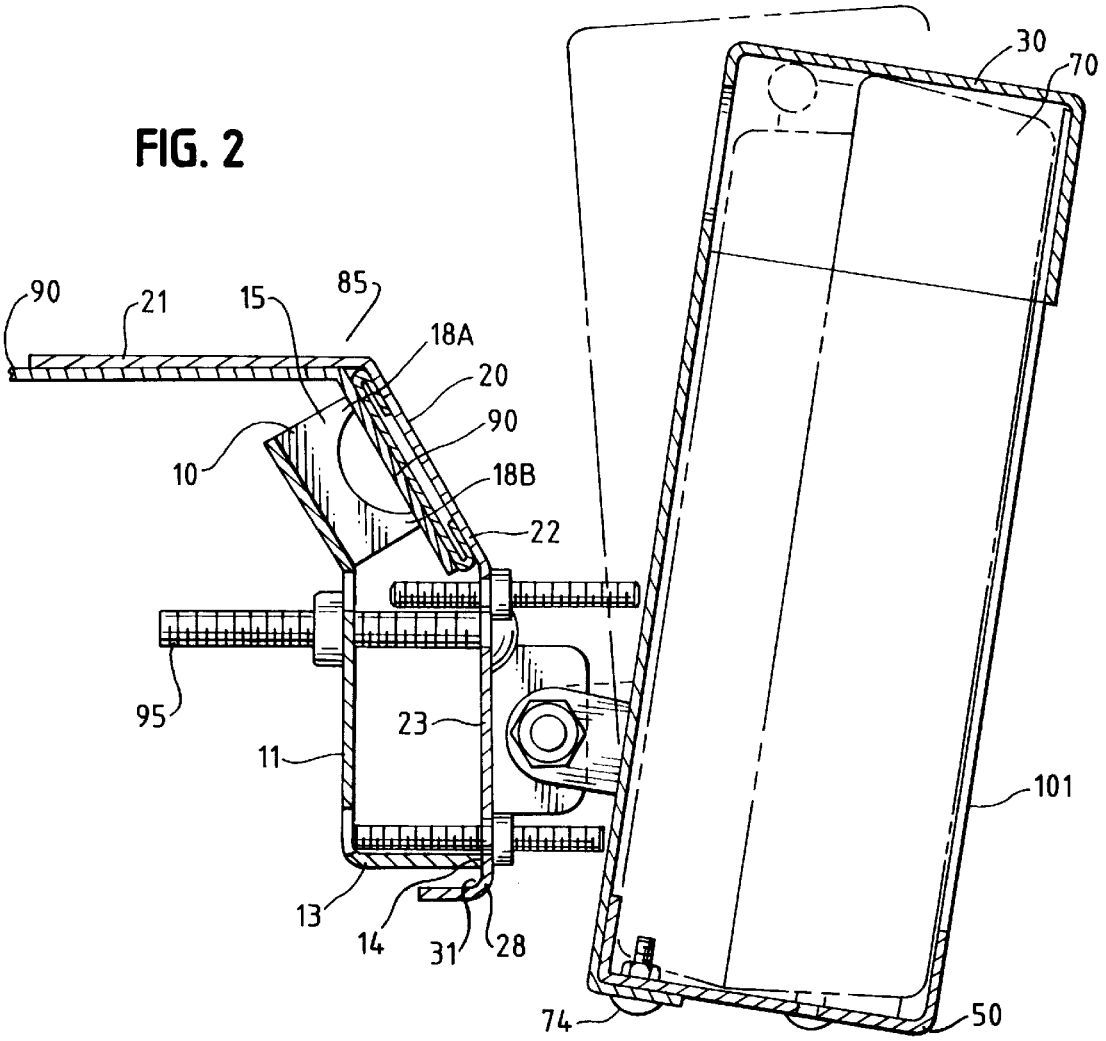
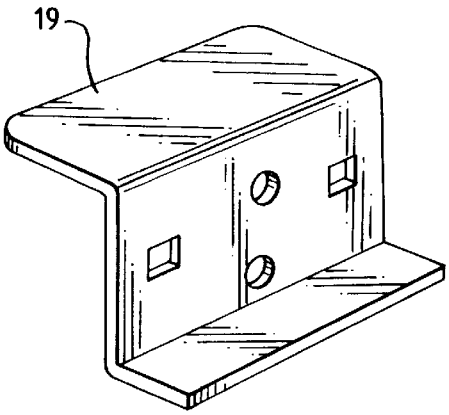
FIG. 3
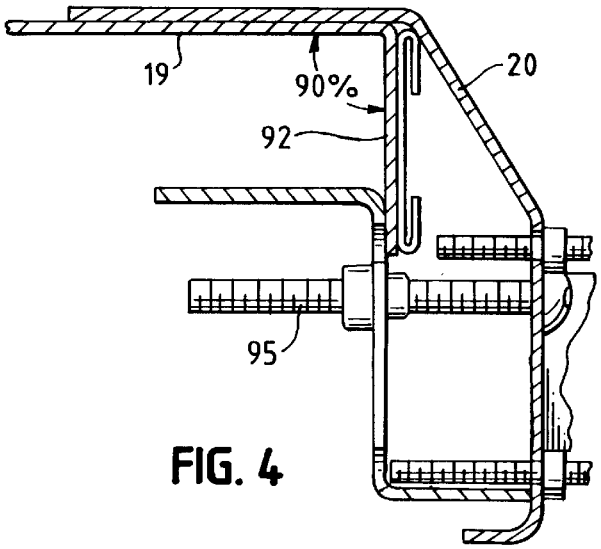
FIG. 4

SECURITY DEVICE

BACKGROUND OF THE INVENTION

The invention relates to a security device that encloses an electronic monitor or some other device to a shelving unit in a tamper resistant manner. More specifically, the present invention uses two plates that are releasably affixed to the shelf by threaded fasteners that bias the plates together and clamp the shelf there between. Mounted to one of the plates is a housing enclosure that surrounds and mounts a video monitor or some other device to the shelf in a tamper resistant manner.

SUMMARY OF THE INVENTION

In retail settings, it is becoming popular to mount electronic devices such as video monitors, coupon dispensers and the like to store shelves (commonly called gondolas) to draw the consumer's attention to a product typically located nearby. Often times the, device is valuable and needs to be protected from theft and tampering while still providing flexibility in accessing the device and locating the device on the gondola. In addition, because it is undesirable to permanently affix an object to the gondola, the security device should be removable by authorized personnel while resisting removal by others.

The security device of the present invention provides such a device by first providing a clamp that is itself removably mounted to the gondola in a tamper resistant manner. Then, the device is enclosed in a tamper resistant housing unit that is formed by first and second housing sections that substantially enclose the device and are sized to fit within one another to create a plurality of stop points which prevent the unauthorized separation of the housings. The housing unit is then mounted to the clamp by fasteners.

DESCRIPTION OF THE DRAWINGS

FIG. 2 is a sectional view of the embodiment shown in FIG. 1 taken along lines 2—2.

FIG. 3 is an exploded perspective view of a plate that is used with a 90 degree gondola face.

FIG. 4 is sectional view of the plate shown in FIG. 3 in use.

DESCRIPTION OF THE PREFERRED EMBODIMENT

Figure 1:
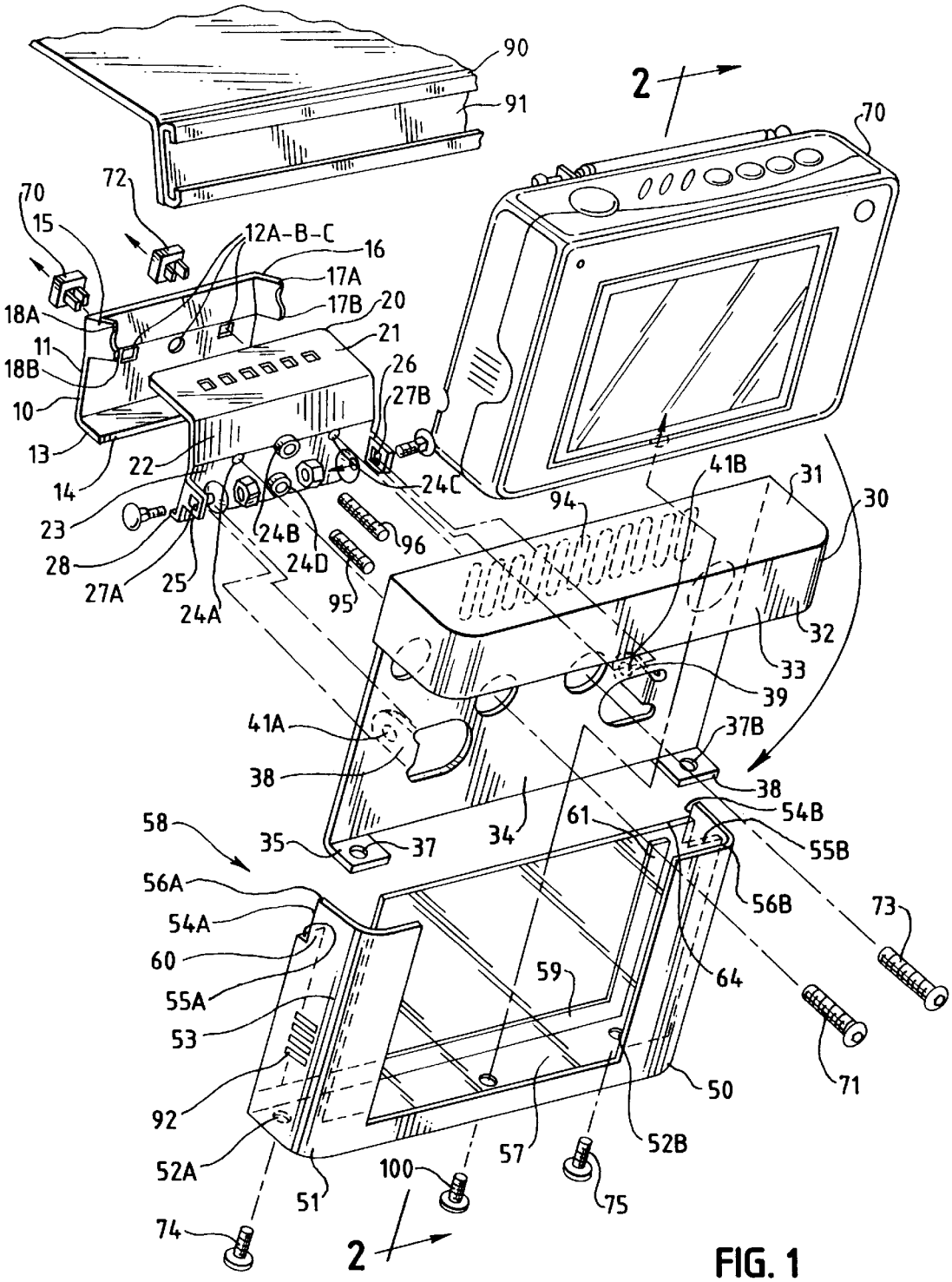
FIG. 1 is an exploded perspective view of one embodiment of the present invention.

As shown in FIG. 1, a preferred embodiment of the invention consists of a clamp plate 10, swivel plate 20, first housing enclosure 30 and second housing enclosure 50, all of which may be made from stamped metal, that work in combination to create a security device 85 that encloses and mounts a device 80 to gondola 90. As shown, device 80 is a video monitor but it may also be any other device that is of value or needs to be protected from theft and/or tampering. Moreover, because the devices to be protected are often made of a plastic or from some other breakable material, the invention also adds a further layer of protection from breakage as well.

As shown in FIGS. 1 and 2, clamp plate 10 includes an vertical portion 11 having disposed thereon apertures 12A, 12B, 12C and 12D and a horizontal portion 13 that has a leading edge 14. Located on vertical portion 11 are two outwardly extending fingers 15 and 16 having contact points

17A, 17B, 18A, and 18B which are angled at 45 degrees to match the angle formed by the leading edge 91 of gondola 90. Of course, it should be understood that although a 45 degree angle is most commonly found on a gondola, other angles may be found and the fingers would be angled accordingly to match the angle used.

As shown in FIG. 4, in applications in which face 92 is 90 degrees as shown in FIGS. 3 and 4 (another common angle), fingers 15 and 16 are replaced with a horizontal portion 19 which extends away from the gondola face 92.

Swivel plate 20, as shown in FIG. 1, is comprised of a first horizontal section 21; angled section 22; vertical section 23; apertures 24A, 24B, 24C and 24D; and outwardly extending flanges 25 and 26 having apertures 27A and 27B. Apertures 24 A and C are positioned to align with apertures 12 A and C of plate 10 for securing the two plates together through the use of coating fasteners 70–73. In addition, vertical section 23 also includes a lip 28.

To mount plates 10 and 20 to a 45 degree gondola face 91, plate 10 is first positioned under the gondola along the backside of face 91 as shown in FIG. 2. Next, plate 20 is placed over the front-side of face 91 and arranged so that lip 28 is positioned under leading edge 14 so that edge 14 rests up against the backside of vertical portion 23 and nests within junction 31 formed by the surfaces of portions 23 and 28.

Coacting fasteners 70–73 are then used to bias the two plates towards one another to clamp the gondola 90 between the plates. This clamping action secures the plates to the gondola in a releasable manner and it also resists tampering or the unauthorized removal of the plates from the gondola by the creation of a number of stop points which resist the use of force applied in any direction.

For example, as shown in FIG. 2, nesting edge 14 of base portion 105 in juncture 31 formed by base portion 107 creates a stop point that resists vertical, downward, and horizontal forces which may be applied at t hat po int. Likewise, positioning fingers 15 and 16 up against face 91 acts to create stop points that resist the same forces. Additional stop points are created by contacting portions 21 and 22 of plate 20 with the gondola as shown in FIG. 2.

Moreover, it has been found that the plates' resistance to tampering is enhanced by having at least two contact points on the back-side of the gondola. As shown in FIGS. 2 and 4, this is accomplished by either contact points 17 and 18, as shown in FIG. 2, or portion s 11 and 19, as shown in FIG. 4. In both of these embodiments, the stop points created by the two contact points assist in preventing the plates from being rotated off of the gondola.

Once plates 10 and 20 are securely clamped to the gondola, the next step is to securingly enclose device 80 in unitary housing 101 that encloses device, and which, is then affix to plate 20. Housing 101 is formed from enclosures 30 and 50 with first housing enclosure 30 including an enclosed canopy 31 that defines an interior space 33, a back wall 34, a first set of flanges 35 and 36 which include threaded apertures 37A and 37B, and a second set of flanges 38 and 39 having apertures 41A and 41B.

As shown in FIG. 1, second housing enclosure 50 includes a bottom surface 51 with apertures 52A and 52B which are located to correspond with apertures 37, a raised wall 53 configured to fit within interior space 33 and having vertical edges 54A and 54B, first horizontal edges 55A and 55B, and second horizontal edges 56A and 56B. Also included is a front opening 57 defined by wall 53 and a rear opening 58 defined by back wall 59 which has a lower lip 59 and opposingly located side lips 60 and 61.

To securingly lock device 700 within the enclosures, it is first placed within space 33 and the enclosures are then fitted together and within one another so that back wall 34 and flanges 35 and 36 are inserted into second housing 50 while canopy 31 envelops wall 53 and edges 54 and 56. Moreover, as is shown in FIG. 1, if device 700 is a video monitor, opening 57 is configured to outline the video screen and a piece of LEXAN 64 or some other clear material may be inserted between the monitor and wall 53 for further protection of the device.

To form housing 101 enclosures 30 and 50 are fastened together by fasteners 74 and 74 which are inserted through apertures 52 and into threaded apertures 37. The fasteners then bias enclosures 30 and 50 together in an interlocking manner that prevents their separation. The heads of the fasteners should be made of a configuration that is not compatible with straight edge, philips head, or other common wrenches and screwdrivers. In addition, key locks may be used in the place of the fasteners to bias the housings together.

The interlocking relationship between the housing enclosures is achieved by sizing the various edges, surfaces, and the elements described above to cooperate to form a plurality of stop points which co-act against the use of force. For example, the enclosures are sized and configured so that canopy 31 outlines the profile of raised wall 53 and it is sized to be slightly larger than wall 53 so that is rests-against edges 55 while back wall 34 is sized to extend a sufficient length to allow flanges 35 and 36 to contact bottom surface 51. This sized arrangement assists the housing enclosures from separation by the formation of stop points that results in edges 55 contacting canopy 31 to prevent upwardly directed forces, and conversely, this engagement along with the contact between flanges 35 and 36 with surface 57 form other stop points that act to resist downwardly directed forces. In addition, a portion of wall 53 should extend a sufficient length into space 33 so as to prevent access into the interior of the enclosures.

In a similar manner, rearwardly directed forces are resisted by stop points that are created by the engagement of wall 53 with the interior surface of canopy 31. Forwardly directed force are resisted by the stop points created by the engagement of edges 54 against back wall 34. Lastly, access to the interior through opening 58 is minimized by having edges 59–61 envelop back wall 34.

Once the housing enclosures are assembled, the enclosed unit 101 is then affixed to the mounting plates through the use of fasteners which bolt flanges 25, 26 38 and 39 together. Again, the fastener heads should not be of a commonly found shape.

In addition, affixing the housing unit 101 to the plate 20 in this manner permits the angle of the enclosures to be adjusted. Threaded fasteners 95 and 96 may then be used to set the angle.

To assist in the functioning of device 700, audio louvers 92 and vent holes 94 may be provided. In addition, additional apertures in back wall 34 permit access to some of the fasteners as shown in FIG. 1 and, in addition, permits various hard wires to be run to device 700 such coaxial cable and the like.

Lastly, while it would be desirable to have the enclosures mirror the shape of device 700, often times it is impractical to form the housings into a customized shape. In situations in which enclosures are not shaped to outline the device, it may be desirable to fasten the device to one of the housing through a fastener 100 as shown.

While the preferred embodiments of the present invention have been illustrated and described, it will be understood by those of ordinary skill in the art that changes and other modifications can be made without departing from the invention in its broader a spects. Various features of the present invention are set forth in the following claims.

What is claimed is:

1. A security device for mounting a device to be protected on a gondola face comprising:

a clamp adapted to securingly mount said security device and a housing unit;

said clamp comprised of first and second sections, said first section and said second section biased towards one another by threaded fasteners to securingly mount said clamp;

said housing unit is formed by first and second sections that form an enclosure and that are sized to nest together create a plurality of stop points which prevent separation of said housing sections when said housing sections are biased towards one another by a fastening means; and said housing unit is mounted to said clamp.

2. A security device for mounting a device to be protected on a gondola face comprising:

a clamp adapted to securingly mount said security device;

a housing unit releasably mountable to said clamp, said housing unit further including first and second sections which define an interior space;

a fastening means which biases said first and said second sections togther; and said sections including a plurality of stop points which cooperate to prevent said sections from separating when said fastening means is employed.

3. The device of claim 2 wherein said first section includes a canopy which encompasses an upper portion of said second section.

4. The device of claim 2 wherein said clamp is comprised of a first plate and a second plate which are biased toward one another by a fastening means to effectuate clamping.

5. The device of claim 2 wherein said housing unit is positioned on said clamp to prevent access to said fastening means.

6. The device of claim 2 wherein said second section is adapted to engage and surround a lower portion of said first section.

7. The device of claim 2 wherein said housing unit defines a viewing opening and said opening is covered by a clear, hardened material.

8. A clamp for mounting an object to a gondola face comprising:

a first plate and opposingly located second plate;

said first plate including an upper section which includes a pair of extended fingers, a generally planar mid-section containing at least one aperture, and a base portion having an extended horizontal portion which engages said second plate;

said second plate including an upper section which has at least one contact point, a generally planar mid-section containing an aperture, and a base portion;

said apertures positioned on said plates to be in axial alignment;

fastening means insertable through said apertures, said fastening means creates a force which biases said plates toward one another; and said base portions of said plates adapted to engage one another to resist said biasing force created by said fastening means in order to securingly connect said base portions together.

9. The device of claim 8 wherein said first plate includes a horizontal top section and a vertical intermediate section and a horizontal lower section which engages said second plate.

10. An apparatus for mounting a device to a gondola comprising:

a housing unit which is affixed to a clamp by fastening means;

said housing unit comprised of first and second sections, said sections interlock to define an interior space;

said sections further form a plurality of stop points which cooperate to prevent separation of said sections when said housing unit sections are interlocked; and said clamp comprised of a first and second plate, said plates opposing located and are biased toward one another by a fastening means.

11. The device of claim 10 wherein said first housing section includes a canopy which encompasses an upper portion of said second housing section.

12. The device of claim 10 wherein said clamp is comprised of a first plate and a second plate which are biased toward one another by a fastening means to effectuate a clamping action.

13. The device of claim 10 wherein said second section is aadapted to engage and surround a lower portion of said first section.

14. The device of claim 10 wherein said housing unit defines a viewing opening and said viewing opening is covered by a clear, hardened material.

* * * * *